US006852040B1

(12) United States Patent
Williams

(10) Patent No.: US 6,852,040 B1
(45) Date of Patent: Feb. 8, 2005

(54) GOLF BALL LIFTER

(76) Inventor: Erik Williams, 190 Nenue St., Honolulu, HI (US) 96821

( * ) Notice: Subject to any disclaimer, the term of this patent is extended or adjusted under 35 U.S.C. 154(b) by 0 days.

(21) Appl. No.: 10/677,293

(22) Filed: Oct. 3, 2003

(51) Int. Cl.[7] ..... A63B 47/02
(52) U.S. Cl. ..... 473/286; 294/19.2
(58) Field of Search ..... 473/286; 294/19.2

(56) References Cited

U.S. PATENT DOCUMENTS

| | | | | | |
|---|---|---|---|---|---|
| 1,830,520 | A | | 11/1931 | Moyses | |
| 4,021,068 | A | | 5/1977 | Piazza | |
| 5,190,288 | A | | 3/1993 | Rogers | |
| 5,299,846 | A | * | 4/1994 | Rush | 294/19.2 |
| 5,328,174 | A | * | 7/1994 | Reeder | 473/239 |
| 5,423,543 | A | | 6/1995 | Tarrant | |
| 5,460,366 | A | | 10/1995 | Pugh | |
| 5,690,558 | A | | 11/1997 | Huber | |
| 6,120,387 | A | | 9/2000 | Bobst | |
| 6,409,611 | B1 | | 6/2002 | Louk, Jr. | |
| 6,638,177 | B1 | * | 10/2003 | Wang | 473/286 |
| 2002/0169030 | A1 | * | 11/2002 | Chun-Sheng | 473/286 |

FOREIGN PATENT DOCUMENTS

| | | |
|---|---|---|
| EP | 0 453 120 A1 | 10/1991 |
| GB | 2 128 484 A | 5/1984 |

* cited by examiner

*Primary Examiner*—Stephen Blau
(74) *Attorney, Agent, or Firm*—Richard C. Litman

(57) ABSTRACT

A golf ball lifter and retriever made of a flexible, resilient, yet relatively stiff elastomeric plastic or rubber material for durability and function during repeated and extended use. The lifter may be mounted on the butt end of a club grip and is generally cylindrical having a ball engaging end portion and a club grip engaging end portion separated by a solid wall, the ball engaging end portion having four tapered fingers formed, by lengthwise slits extending inward from the ball engaging end of the lifter.

The tapered fingers have gripping lips at the ball-engaging end. The slits are formed by the longitudinal edges of the tapered fingers and end in a circular bore acting as an edge joint and have two parallel circumferential ribs extending inward from the inner wall of the fingers for gripping the golf ball, the first rib being an inward extension of the gripping lips.

17 Claims, 7 Drawing Sheets

GOLF BALL LIFTER

BACKGROUND OF THE INVENTION

1. Field of the Invention

The present invention relates to retrievers. More particularly, the present invention relates to a golf ball lifter and retriever.

2. Description of the Related Art

The playing of the game of golf involves reaching over to pick up a golf ball for marking, cleaning, and removal of the ball from the cup. This involves substantial effort, particularly for those players with physical limitations. Known golf ball lifters- or retrievers are complex, require carrying an extra shaft, are bulky, are limited in function, or are subject to quick deterioration during use. It would be desirable to provide a golf ball lifter and retriever which may easily be carried by the user or mounted on the butt end of a club grip, is rugged such as to withstand repeated use and avoid damage when the club upon it is mounted is placed in a golf bag, and is effective for easily lifting a ball from the ground or a golf cup and provides for easy removal of the ball by the user.

U.S. Pat. No. 1,830,520, issued Nov. 3, 1931, to Moyses, describes a golf ball lifter employing a suction cup mountable on the end of the grip of a golf club or the like such as a putter.

U.S. Pat. No. 4,021,068, issued May 3, 1977, to Piazza, describes a golf ball retriever for retrieving a golf ball from a hazard such as water, sand, or rough which employs a vacuum pumped golf ball receiver.

U.S. Pat. No. 5,190,288, issued Mar. 2, 1993, to Rogers, describes a golf club attachable ball retriever which is collapsible to be carried flat in a pocket. The retriever has two fingers having indentations for holding the golf ball.

U.S. Pat. No. 5,423,543, issued Jun. 13, 1995, to Tarrant, describes a specialized golf shaft having ball mark repair elements extending from the grip and a scoop-like golf ball lifter for scooping the ball from the golf cup.

U.S. Pat. No. 5,460,366, issued Oct. 24, 1998, to Pugh, describes a golf ball retriever for fitting on the butt end of a golf club grip having pairs of opposed elastic fingers which slip over and close on a golf ball to be lifted or retrieved.

U.S. Pat. No. 5,690,558, issued Nov. 24, 1997, to Huber, describes a golf ball lifter or retriever having two opposed golf ball gripping fingers and a device for dropping a marker for putting.

U.S. Pat. No. 6,120,387, issued Sep. 19, 2000, to Bobst, describes a golf ball retriever system for attachment to the butt end of a golf grip which is cylindrical, having an elastomeric lock near its base when in use which stretches over the golf ball upon application of downward force and traps the ball in the cylinder for removal through an upper sidewall opening.

U.S. Pat. No. 6,409,611, issued Jun. 25, 2002, to Louk, Jr. et al. describes a golf swing training umbrella having a removable ball retrieving scoop at the butt end of the handle for retrieving golf balls from hazards such as water.

British Patent No. GB2 128 484 A, published May 2, 0.1984, describes a golf ball retriever having a polymeric cup having a rib which stretches over the golf ball for securing and lifting the ball.

European Patent Application EP 0 435,120 A1, published Oct. 23, 1991, describes a golf ball retriever as part of a golf club grip having spring loaded fingers for grasping the golf ball.

None of the above inventions and patents, taken either singly or in combination, is seen to describe the instant invention as claimed. Thus, a golf ball lifter solving the aforementioned problems is desired.

SUMMARY OF THE INVENTION

The present invention is a golf ball lifter and retriever made of a flexible, resilient, yet relatively stiff elastomeric plastic or rubber material for durability and function during repeated and extended use. The inventive ball lifter may easily be separately carried in the pocket of a golf bag or the like and may be mounted on the butt end of a club grip such as that of a putter. The inventive ball lifter may remain on the grip of the club for extended periods, the lifter/retriever remaining on the club when stored in a golf bag in the normal manner without sustaining damage from the bag. The inventive ball lifter is generally cylindrical in shape having a ball engaging end portion and a club grip engaging end portion separated by a solid wall, the ball engaging end portion having four tapered fingers formed by lengthwise slits extending inward from the ball engaging end of the lifter.

The tapered fingers are in the general shape of truncated triangles forming gripping lips at the ball-engaging end. The slits are formed by the longitudinal edges of the tapered fingers and end in a circular bore acting as edge joints to avoid cracking at the end of the slits during repeated use. The fingers thus formed have two or more parallel circumferential ribs extending inward from the inner wall of the respective fingers to provide grip for holding the golf ball, the first rib being an inward extension of the gripping lips.

The fingers are spread apart when receiving the golf ball through downward pressure thereon and the gripping ribs have been found effective in retaining the ball, regardless of dimple size or pattern. The ball is mechanically held due to the elasticity of the elastomeric fingers and ribs and does not require suction for engagement, suction being unreliable due to dimples, irregularities, or debris or mud on the ball surface. The fingers are stretched from their rest position when engaging the ball and, due to their elasticity, grip the ball with the inner ribs. The fingers and ribs adequately grip a golf ball for lifting by engaging a portion of the ball which is less than a full hemisphere, allowing the lifter to be smaller in size than many of the previously described lifters or retrievers. The inventive lifter is useful in lifting a golf ball from a grassy surface such as a golf green and from the bottom of a golf cup. The lifter may also be useful for retrieving a ball from a hazard.

Accordingly, it is a principal object of the invention to provide a golf ball lifter mountable on a shaft such as the butt end of a golf club.

It is another object of the invention to provide a golf ball lifter as above which releasably grips a golf ball regardless of dimple size and pattern.

It is a further object of the invention to provide a golf ball lifter as above which secures a golf ball by engaging a portion of the ball which is less than a full hemisphere.

Still another object of the invention is to provide a; golf ball lifter as above which is relatively small for ease in carrying.

Yet another object of the invention is to provide a golf ball lifter as above which is equally effective in lifting a ball from a grassy surface or from a golf cup.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a golf ball lifter for fitting over a shaft such as the butt end of a golf club grip and useful for gripping a golf ball and lifting it from a grassy surface such as a golf green or from the bottom of a golf cup. The ball may then be easily removed from the lifter, the user avoiding bending over to reach for the ball from the green or cup. The golf ball lifter may also be useful for retrieving a golf ball from a hazard.

Figure 1:
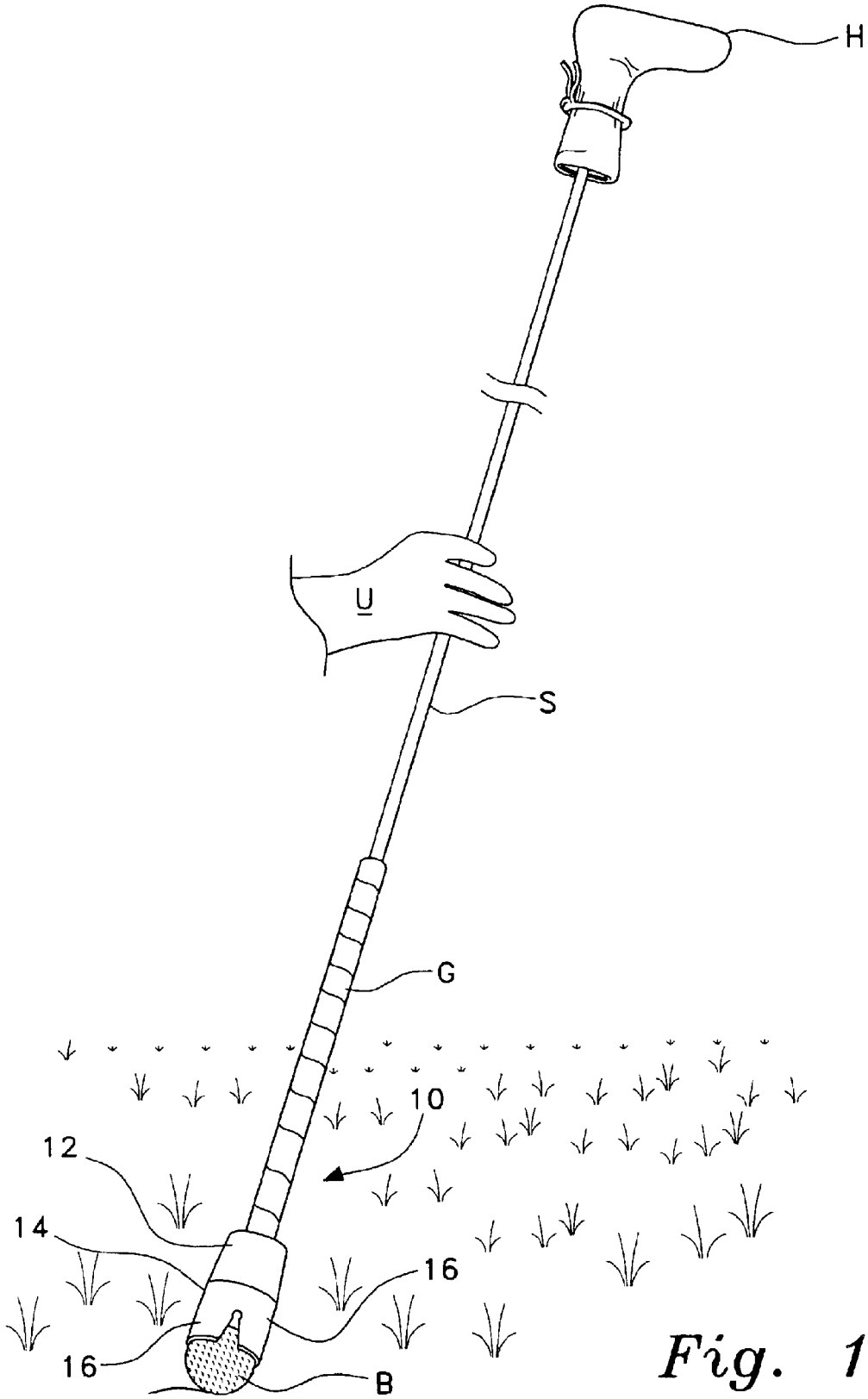
FIG. 1 is an environmental, perspective view of a golf ball lifter according to the present invention engaging a golf ball on a putting surface.
Figure 2:
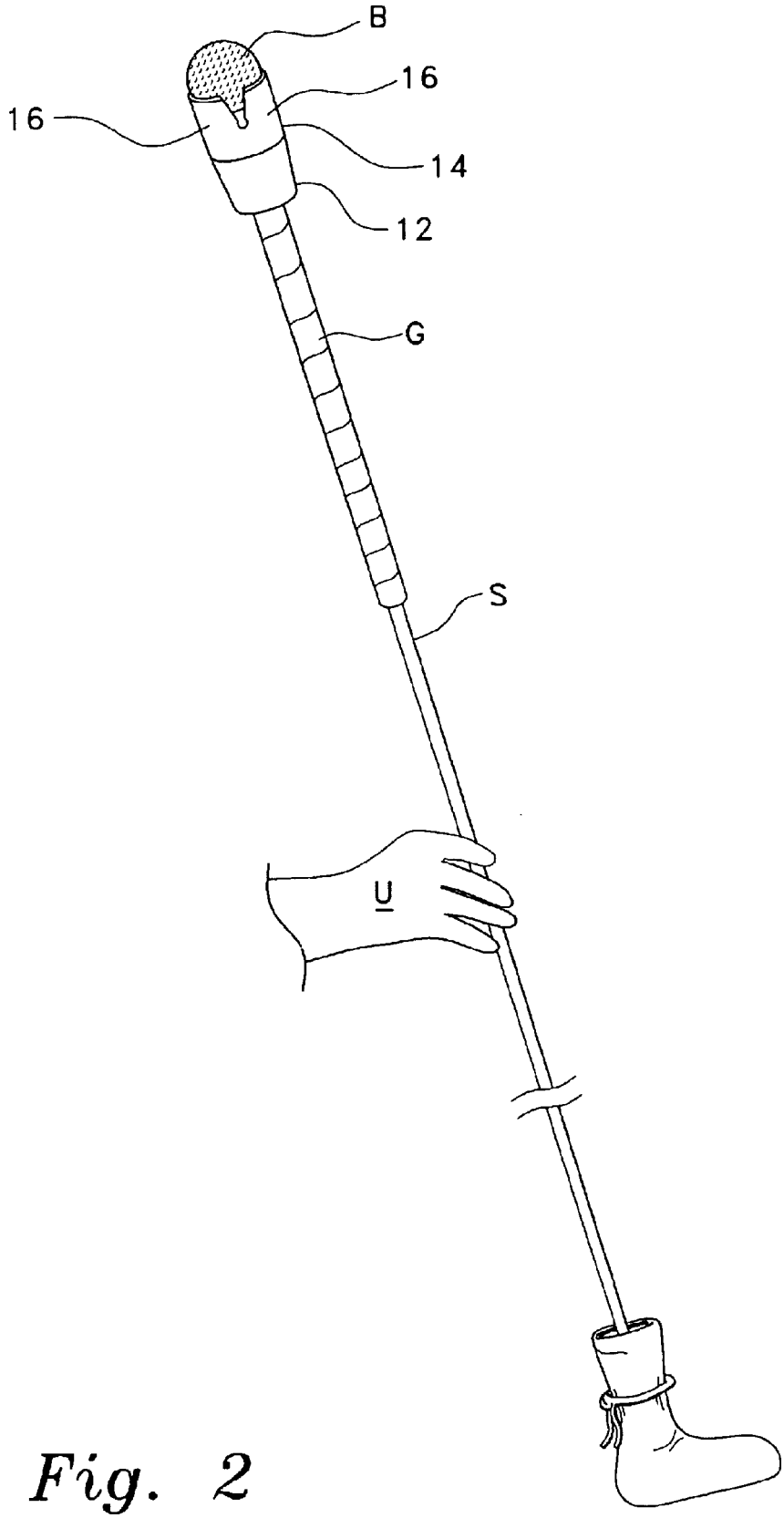
FIG. 2 is an environmental, perspective view of the golf ball lifter according to the present invention after lifting the ball to a position to be easily removed by the user.
Figure 3:
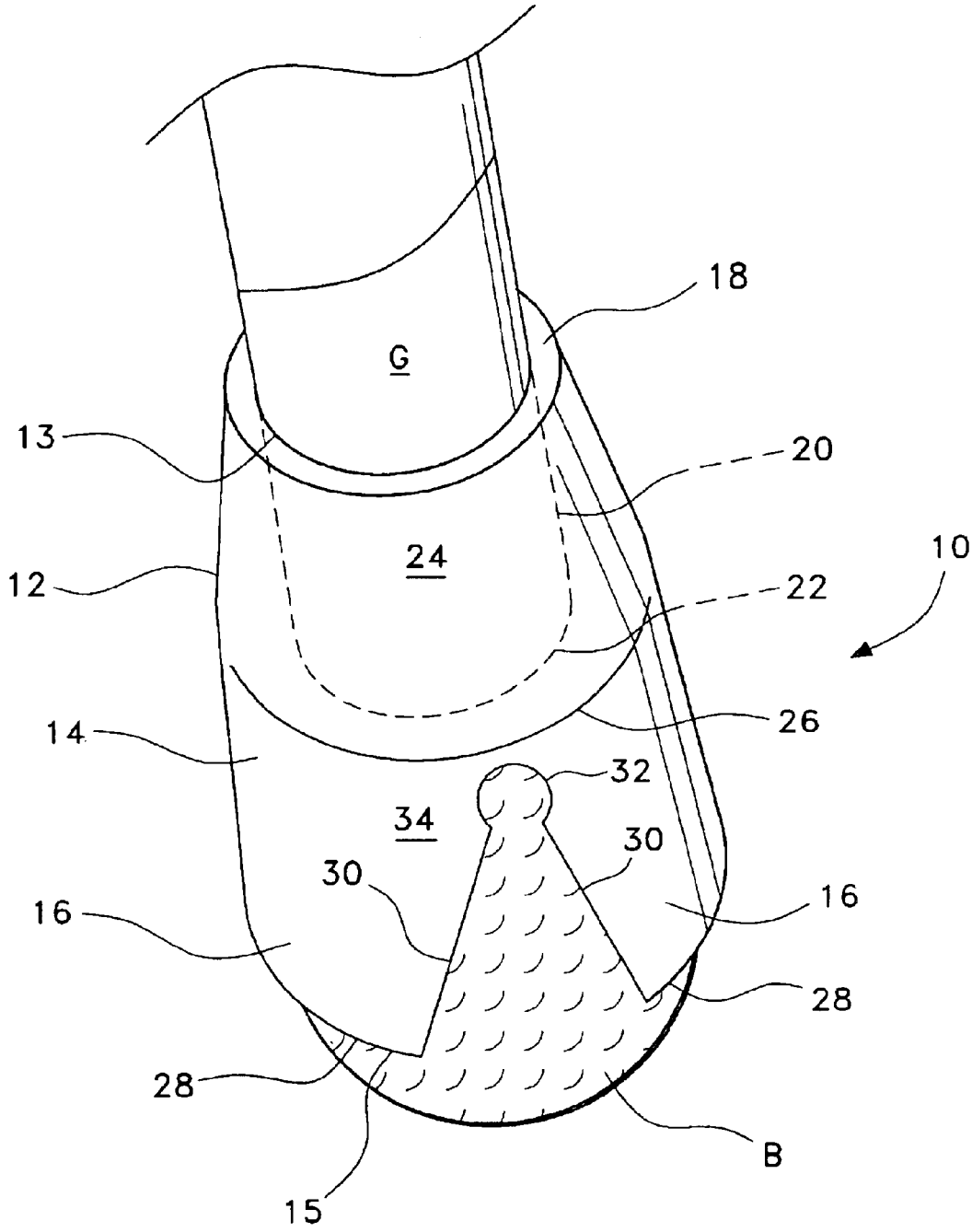
FIG. 3 is a detail perspective view of the golf ball lifter of FIG. 1 as installed on the butt end of a golf club grip.
Figure 4A:
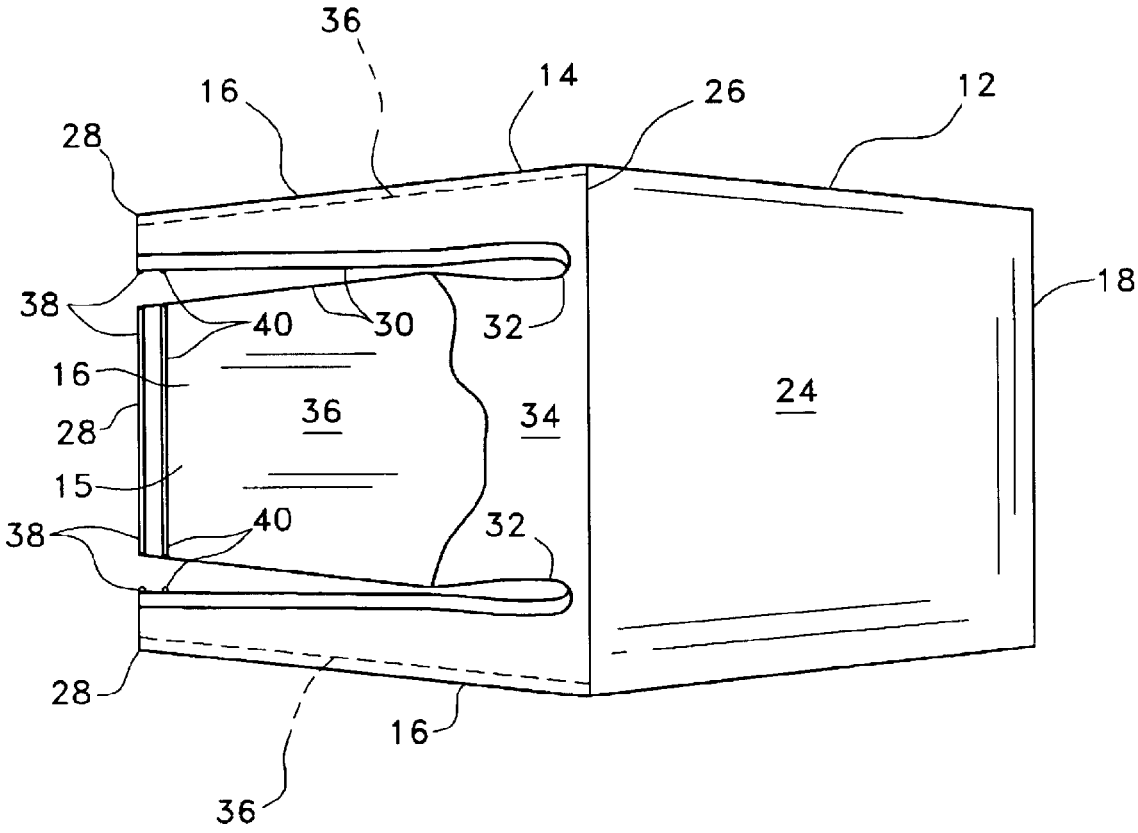
FIG. 4A is a side elevation view of the golf ball lifter of FIG. 1 with a finger partially cut away.
Figure 4B:
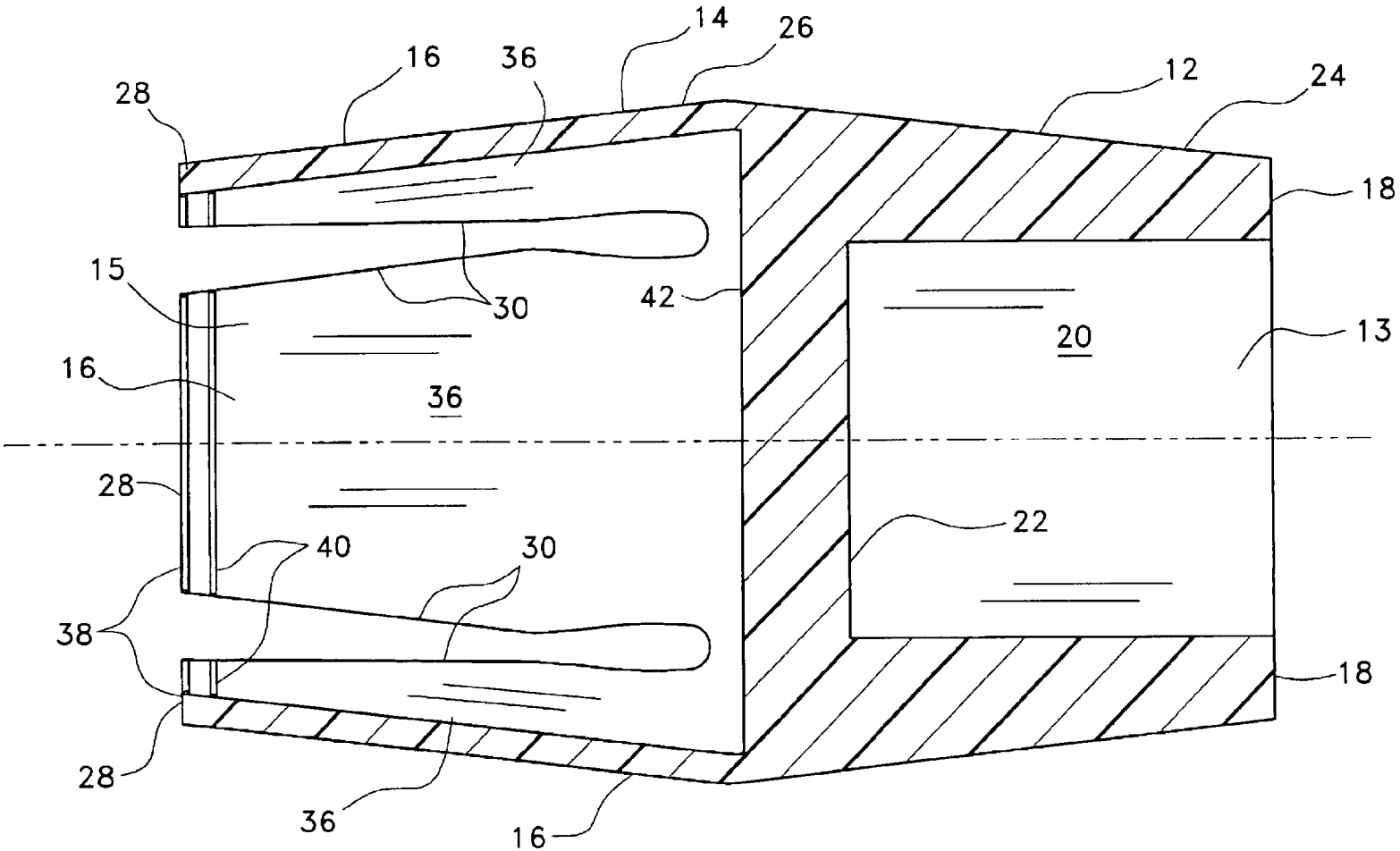
FIG. 4B is a sectional view of the golf ball lifter of FIG. 4A.
Figure 5:
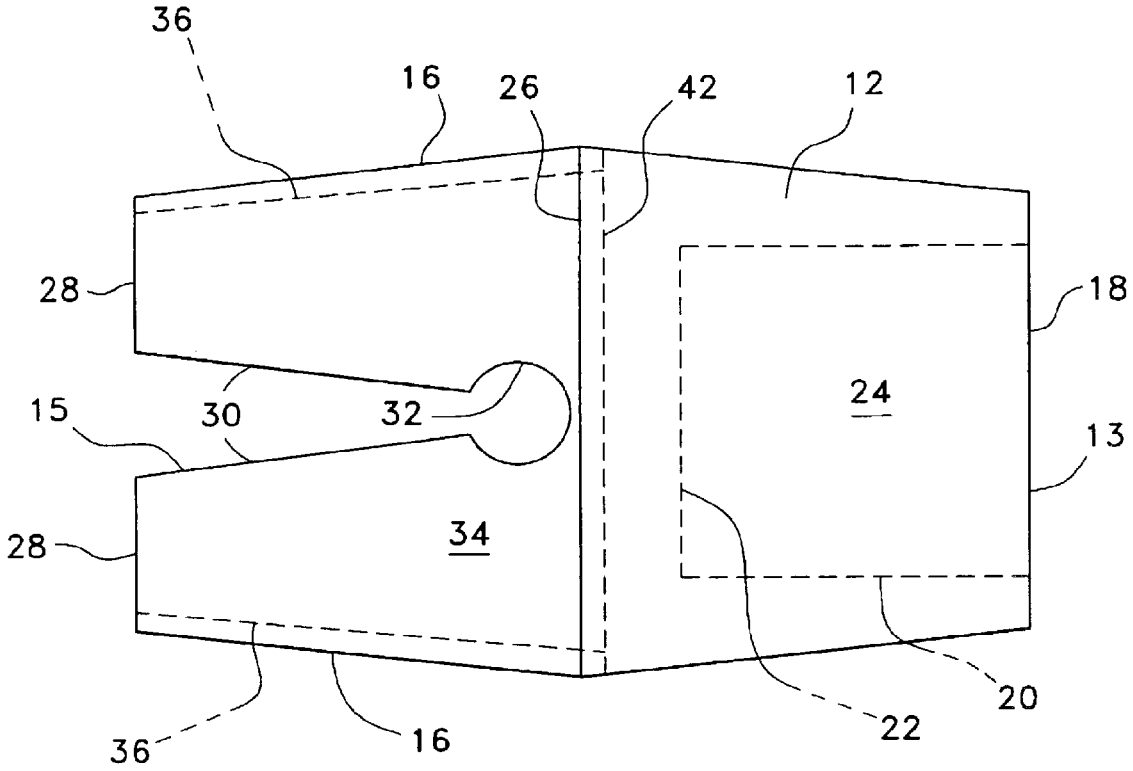
FIG. 5 is a side elevation view of the golf ball lifter of FIG. 4A rotated 45 degrees around its central longitudinal axis.
Figure 6:
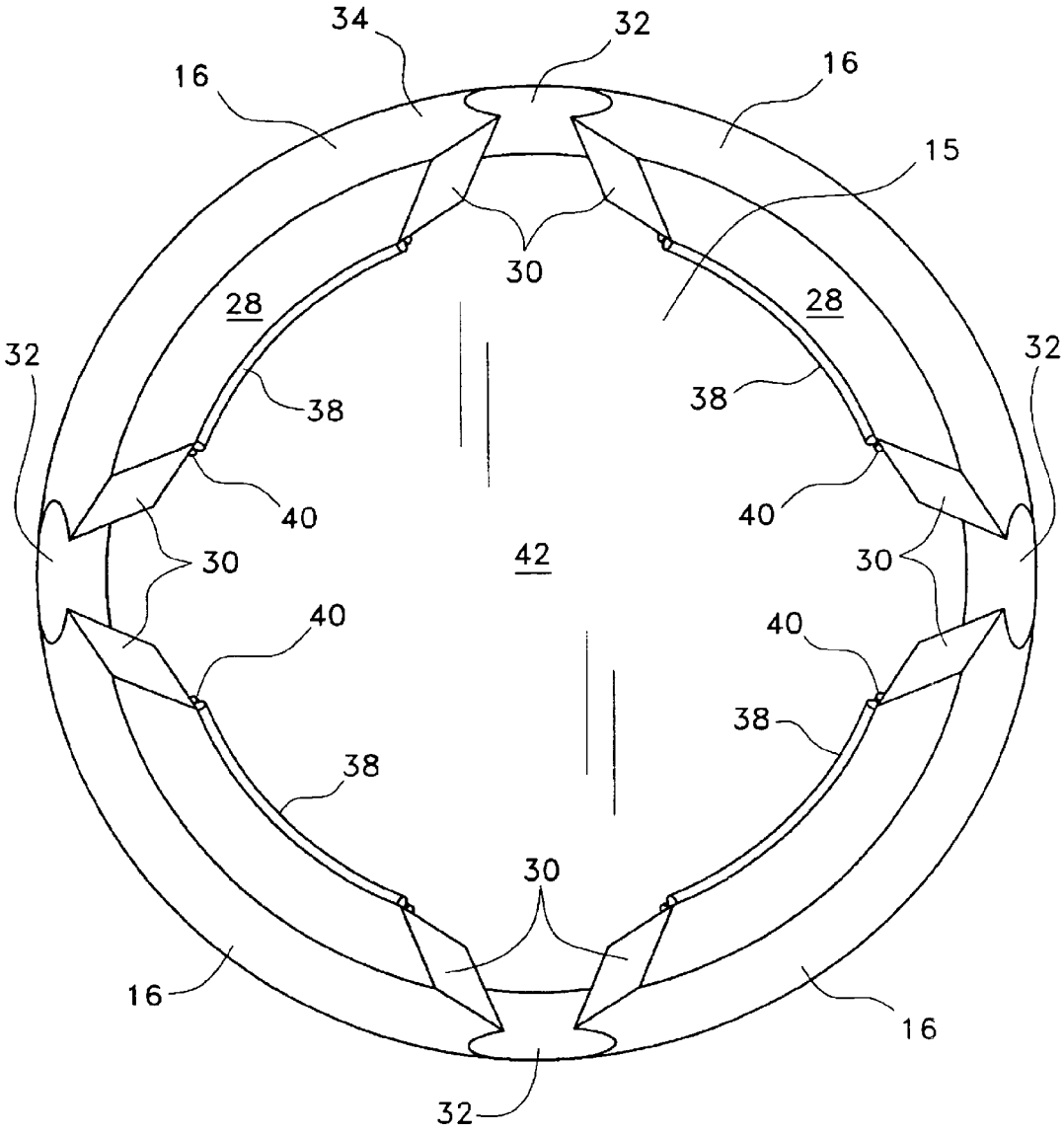
FIG. 6 is an end view of the golf ball lifter of FIG. 4A looking at the golf ball engaging portion.

Referring to the Figures, golf ball lifter 10 has a grip attachment portion 12 for mounting on a shaft such as the butt end of the grip G of a golf club having a shaft S and a head H (shown in FIGS. 1–3 with a head cover such as that used on a putter). The golf ball lifter 10 is generally cylindrical in shape, having a central longitudinal axis and has a golf ball engaging portion 14 extending from the attachment portion 12. Ball engaging portion 14 has outward extending golf ball gripping fingers 16 which expand and grip the golf ball B upon application of pressure by the user U on the lifter 10 by means such as shaft S of the golf club. The club may then be lifted and rotated to a position as in FIG. 2 where the user U may easily remove the ball B from the gripping fingers 16, grasping the ball with his other hand (not shown).

Referring to FIGS. 3–6, a detail of FIG. 1 (see FIG. 3) is shown with the lifter 10 mounted on grip G and grasping golf ball B. As is shown, golf ball engaging portion 14 of lifter 10 has outward extending gripping fingers 16 expanded outward from the rest position as shown, for example, in FIG. 4. The lifter 10 is made of a stiff elastomeric material such as plastic or hard rubber, the fingers 16 of which exert a radially inward force on the ball B working opposed to each other resulting in the gripping of the golf ball. The preferred number of gripping fingers is four as shown in the Figures, however a smaller or larger number of fingers may be employed in the lifter device 10. Lifter attachment portion 12 is generally cylindrical in shape and tubular in construction, having a grip entrance lip 18 at the grip receiving end of grip receiving cavity 13. Lifter attachment portion 12 has a cylindrical inner side wall extending from lip 18 to an inner end wall 22 forming grip receiving cavity 13 for receiving and retaining the butt end portion of grip G. The cylindrical inner sidewall is of such diameter as to form a friction fitting with the grip G and, being made of elastomeric material, may be slightly expanded to fit a desired shaft.

Grip attachment portion 12 has an outer cylindrical wall 24, which preferably tapers outward from the lip 18 at the grip G to the connection with ball engaging portion 14 for ease of grip insertion, economy of material, and a smooth overall form and neat appearance. The grip attachment portion 12 ends in a circumferential outer edge 26 from which golf ball engaging portion 14 extends.

Golf ball engaging portion 14 is generally cylindrical in shape and tubular in construction having a longitudinal central axis coinciding with that of the grip attachment portion 12. Ball engaging portion 14 forms a golf ball receiving cavity 15 defined by wall 34 of uniform thickness which tapers radially inward from circumferential outer edge 26 and inner end wall 42 (see FIGS. 5 and 6) as it extends outward, ending in gripping finger lips 28. Gripping fingers 16 are formed in the cylindrical wall 34 by longitudinal edges 30 extending outward from circular edge joints 32, equally spaced outward from circumferential outer edge 26, to the extreme end of ball engaging portion 14 as defined by lips 28. Fingers 16 are in the general shape of a truncated triangle extending outward from the edge joints 26 and are preferably the same length.

The gripping fingers 16 form expanding slits therebetween along their length which are generally triangular in shape, expanding along their length as the gripping fingers are spread over a golf ball B (see FIG. 3). Gripping finger lips 28 form a segmented circle at a location along the central axis of the golf ball lifter 12 which defines the outer end of the golf ball engaging portion 14. The gripping fingers 16 each have an outer gripping rib 38 extending radially inward as an inward extension of the respective lips 28 and an inner gripping rib 40 spaced axially inward from and parallel with outer gripping rib 38 along inner wall surface 36 of engaging portion wall 34. The gripping ribs are preferably bead-shaped, having a half circular cross section, and additional gripping ribs may be added, spaced inward and parallel with gripping ribs 38 and 40 along inner wall surface 36 as desired. Each of the gripping ribs extend the entire radial distance between longitudinal edges 30 of its respective gripping finger 16. The gripping ribs 38 and 40 provide for an enhanced grip of the golf ball by gripping fingers 16.

In operation, golf ball lifter 10 is installed over the butt end of a golf club grip G by inserting grip G into grip receiving cavity 13 in tubular grip attachment portion 12 through lip 18 until inner end wall 22 is reached. A friction or stretch fit is induced between the grip attachment portion 12 and the grip G. The user U then inverts the shaft S and places the gripping fingers 16 of ball engaging portion 14 over and against the golf ball B as it rests on a grassy surface or in the bottom of a golf cup. The user then exerts downward pressure on the shaft, forcing gripping fingers 16 to expand outward as they slide over the upper surface of the golf ball. The user continues pressing downward, forcing fingers 16 downward and outward over the ball surface until a grip is achieved on the golf ball B within the end portion of golf ball receiving cavity 15. This is determined by lifting the shaft S slightly to check if the ball is secured to the ball lifter 12 and, thus, lifts with upward movement of the shaft S. Once securely engaged with the golf ball and the ball is lifted from the ground or cup, the ball lifter is rotated upward by the user U by rotating the shaft until the golf ball is easily grasped by the user's other hand. The user may then easily grasp the ball and pull it from the fingers of the lifter. The fingers of the lifter then return to their rest position due to the spring action of the elastic material of the lifter.

The preferred dimensions of the golf ball lifter 10 include an overall axial length of 2¾ inches and a maximum diameter of 1⅝ inches. The maximum diameter of the grip attachment lip is 1 5/16 inches and the inside diameter of the tubular attachment portion is 1 1/16 inches. The depth of the grip attachment portion is 1 1/16 inches axial length between the lip and the inner end wall thereof forming the grip receiving cavity. The diameter of the ball engaging portion when at rest is 1 3/8 inches at the gripping finger lips. The internal axial length between the gripping finger lips and the inner wall 36 forming the receiving cavity is 1 1/4 inches. The thickness of the grip attachment lip is 1/8 inches and the thickness of the engaging portion wall including the gripping fingers is 1/8 inch. The diameter of the circular finger edge joints are 1/4 inch and the spacing between gripping fingers at rest measured between the respective lips is 3/8 inches. The radial thickness of the bead shaped gripping ribs is from 1 to 2 millimeters and the axial spacing of the inner gripping rib 40 and the outer gripping rib 38 is about 0.5 centimeters. Dimensions may vary within a range as desired.

The inventive golf ball lifter is an integral structure, preferably made of a flexible, resilient, yet relatively stiff elastomeric plastic or rubber material such as that useful for furniture leg coasters. The material should have resilient properties such that when the fingers are pressed over a golf ball, a sufficient gripping force is developed in the finger and upon removal of the golf ball the fingers return to their rest position.

It is to be understood that the present invention is not limited to the embodiment described above, but encompasses any and all embodiments within the scope of the following claims.

I claim:

1. An integral golf ball lifter for attachment to a shaft such as a golf club grip having a generally cylindrical body having a central axis, said body being made of resilient elastomeric material and comprising:

a tubular attachment portion extending along said central axis;

said attachment portion defining a grip receiving cavity having an entrance lip, an inner sidewall, an inner endwall, an outer sidewall, and a circumferential outer edge, said inner sidewall extending axially from said entrance lip to said inner endwall, said outer sidewall extending axially from said entrance lip to said circumferential outer edge; and a tubular golf ball engaging portion extending axially outward from said attachment portion along said central axis;

said golf ball engaging portion having a generally cylindrical wall extending from said circumferential outer edge and an inner endwall; said cylindrical wall and said inner endwall defining a golf ball receiving cavity; said cylindrical wall comprising gripping fingers extending axially outward from an axial location spaced from said inner endwall and defined by longitudinal edges forming slits therebetween; said gripping fingers having gripping finger lips at a common axial end location;

wherein said ball engaging portion tapers axially inward from said circumferential outer edge to said gripping finger lips;

whereby said golf ball lifter is mounted on a shaft by means of said attachment portion grip receiving cavity;

whereby said gripping finger lips are placed over and against the upper portion of a golf ball resting on a surface by a users manipulating a golf club shaft extending from a golf club grip; and whereby said user applies downward pressure on the shaft, forcing said gripping fingers to expand radially outward around the upper surface of the golf ball to a point such that said gripping fingers grasp the ball within said ball receiving cavity with sufficient force to allow the ball to be lifted from the surface to an elevation easily reached by the user's hand by manipulation of the shaft.

2. The golf ball lifter of claim 1, wherein each said gripping finger has an inner wall surface and comprises at least one gripping rib extending radially inward from said inner wall surface and extending axially parallel to said gripping finger lip in the vicinity thereof.

3. The golf ball lifter of claim 2, wherein an outer one of said at least one gripping ribs is a radially inward extension of said gripping finger lip.

4. The golf ball lifter of claim 3, further comprising a second gripping rib spaced axially inward from said outer gripping rib.

5. The golf ball lifter of claim 4, wherein said gripping fingers are each in the form of a truncated triangle, said lips forming a segmented circle.

6. The golf ball lifter of claim 5, wherein said gripping fingers define triangular slits extending from a point axially spaced outward from said circumferential outer edge outward to said gripping finger lips.

7. The golf ball lifter of claim 6, wherein said golf ball engaging portion cylindrical wall defines circular gripping finger edge joints from which corresponding said triangular slits longitudinally outwardly extend.

8. The golf ball lifter of claim 7, wherein said golf ball engaging portion comprises four golf ball engaging fingers defining four triangular slits.

9. The golf ball lifter of claim 7, wherein the diameter of said circular finger edge joints is about 1/4 inch and the spacing between gripping fingers at rest as measured between the respective lips is about 3/8 inches.

10. The golf ball lifter of claim 4, wherein said each of said gripping ribs extend the entire radial distance between longitudinal edges of its respective gripping finger.

11. The golf ball lifter of claim 1, wherein said tubular attachment portion outer wall tapers axially inward from said circumferential outer edge to said entrance lip.

12. The golf ball lifter of claim 11, wherein said resilient elastomeric material is flexible, yet relatively stiff plastic or rubber material.

13. The golf ball lifter of claim 11, wherein said gripping fingers are identical in dimensions.

14. The golf ball lifter of claim 11, wherein the overall length of said cylindrical body is about 2 3/4 inches and the maximum diameter is about 1 5/8 inches at said circumferential outer edge.

15. The golf ball lifter of claim 11, wherein the maximum diameter of said grip attachment lip is about 1 5/16 inches, the inside diameter of tubular attachment portion forming said grip receiving cavity is about 1 1/16 inches, and the depth of the grip receiving cavity is about 1 1/16 inches axial length between said lip and said inner endwall thereof.

16. The golf ball lifter of claim 11, wherein the diameter of the ball engaging portion when at rest is about 1 3/8 inches at said gripping finger lips, the internal axial length of said golf ball receiving cavity between said finger lips and said inner endwall is about 1 1/4 inches, and the thickness of the engaging portion wall including said gripping fingers is about 1/8 inch.

17. The golf ball lifter of claim 16, wherein a radial thickness of the bead shaped gripping ribs is about from 1 to 2 millimeters and the axial spacing of said inner gripping rib from said outer gripping rib is about 0.5 millimeters.

* * * * *